United States Patent [19]

Lavarnway

[11] 3,948,580

[45] Apr. 6, 1976

[54] FOODS DISPLAY SHELF

[75] Inventor: Jerry L. Lavarnway, Oklahoma City, Okla.

[73] Assignee: Canadian Valley Meat Company, Oklahoma City, Okla.

[22] Filed: July 25, 1974

[21] Appl. No.: 491,892

[52] U.S. Cl. ..... 312/116; 108/27; 108/42; 211/88

[51] Int. Cl.[2] ..... A47F 3/04; A47B 96/06

[58] Field of Search ..... 108/42, 47, 152, 27; 211/86, 88, 90; 248/214, 215; 312/116, 126

[56] References Cited

UNITED STATES PATENTS

| | | | |
|---|---|---|---|
| 1,596,812 | 8/1926 | Curtis et al. | 211/90 X |
| 2,180,502 | 11/1939 | Bonsall | 108/52 UX |
| 2,849,728 | 9/1958 | Gyllenberg | 248/291 X |
| 2,911,108 | 11/1959 | Nield | 108/152 |
| 3,486,632 | 12/1969 | Balch | 211/57 |
| 3,753,543 | 8/1973 | Burrell et al. | 211/88 X |
| 3,765,632 | 10/1973 | Riggs | 248/215 X |
| 3,791,528 | 2/1974 | Brendgord | 211/88 |

*Primary Examiner*—Roy D. Frazier
*Assistant Examiner*—William E. Lyddane
*Attorney, Agent, or Firm*—Robert K. Rhea

[57] ABSTRACT

A horizontally disposed shelf having an upstanding end wall adapted to be connected in cantilever fashion to a horizontal support bar on the forwardly disposed wall surface above food displayed in an open top refrigerated food display case.

1 Claim, 3 Drawing Figures

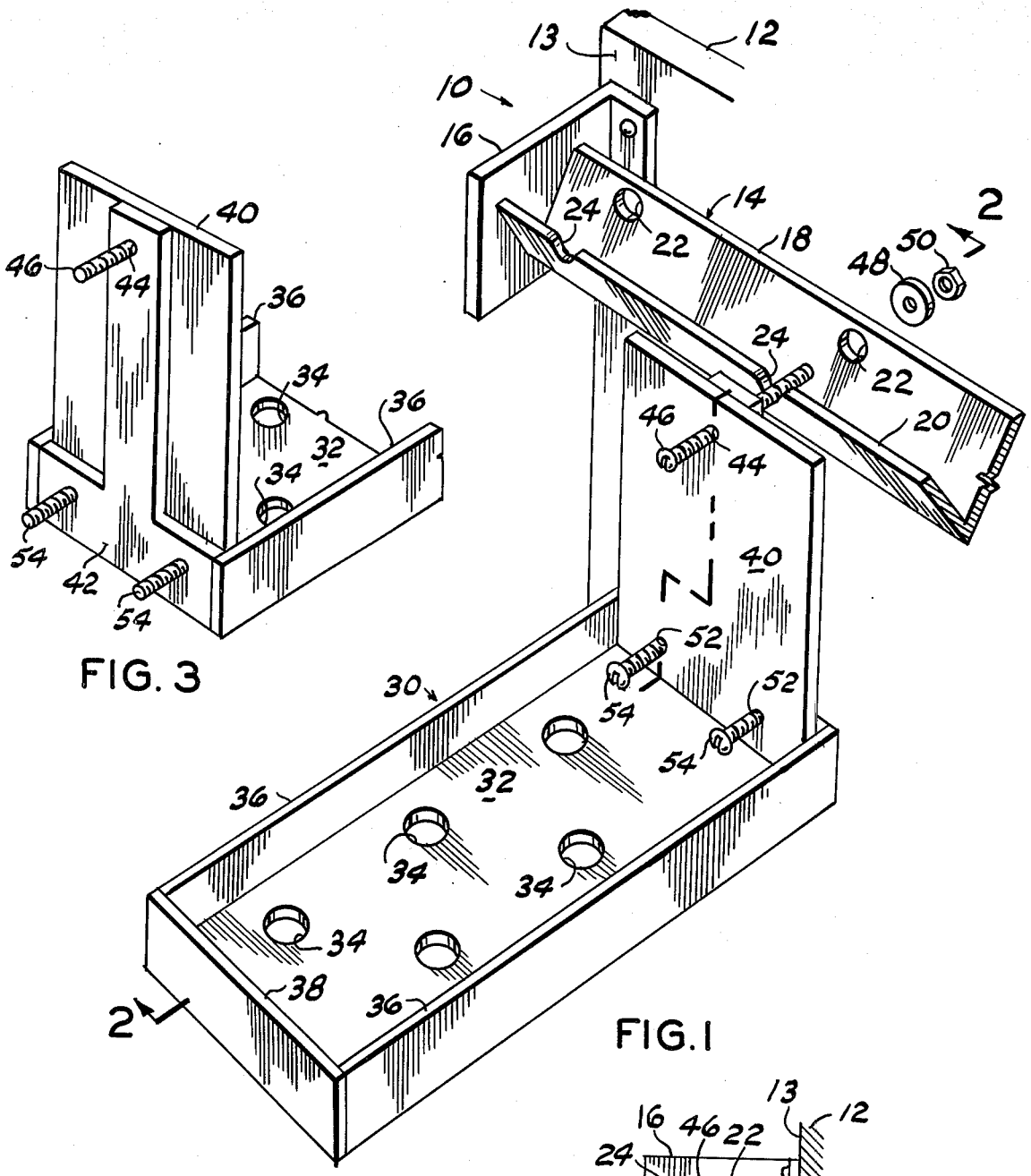
FIG. 3
FIG. 1
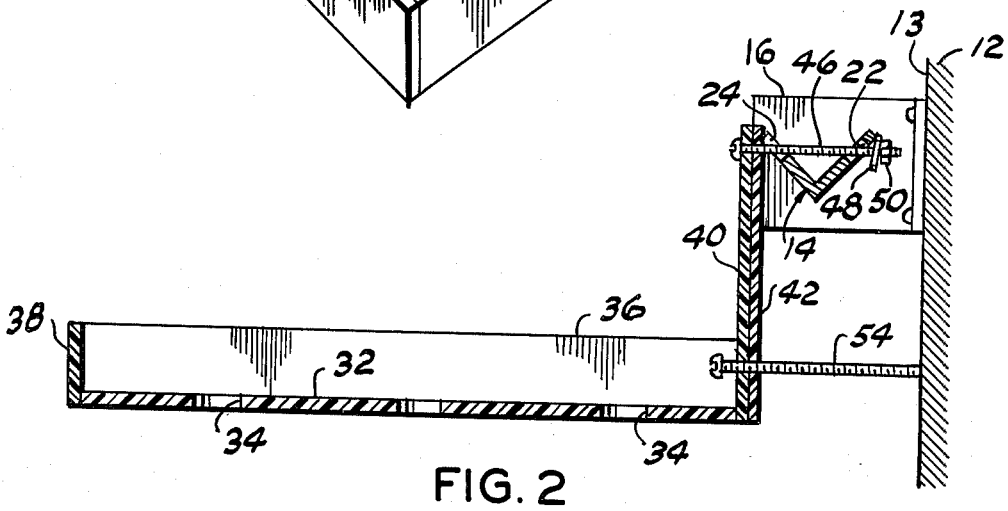
FIG. 2

FOODS DISPLAY SHELF

BACKGROUND OF THE INVENTION

1. Field of the Invention

The present invention relates to refrigerated food containers of the open top refrigerated food display case type and more particularly to a horizontally disposed shelf adapted to be connected with a back wall of the display case intermediate its height.

Upwardly disposed refrigerated food display cases are usually provided with a back wall projecting above the principal plane defining the top of the case with a support bar horizontally supported by the forward surface of the back wall which in turn supports a plurality of rods projecting horizontally forward from the case back wall over the packaged food within the display case for hanging packaged food items on the rod. If these packaged food items are not identical in appearance a customer frequently chooses one of the packages near the connected end of the supporting rod thus necessitating removal of the forwardly disposed packages which are seldom replaced on the rod by the customer.

This invention eliminates the juxtaposed relation of the prepackaged food articles depending from a single support rod by providing a horizontal shelf projecting toward the customer from the case support bar for receiving a plurality of the prepackaged articles of food. This permits the customer to browse through the articles on the shelf and choose one to their liking without removing the remaining articles from the shelf.

2. Description of the Prior Art

Horizontal shelves, as disclosed by the prior patents, have generally related to shelves connected with and projecting outwardly from a window sill, or the like, such as disclosed by U.S. Pat. Nos. 1,224,127 and 2,488,870.

SUMMARY OF THE INVENTION

The shelf comprises a horizontal foraminated panel having upturned flanges along opposing sides and one end with an upstanding support wall at its other end. Elongated bolt means, projecting through the upper end portion of the support wall, is connected with a horizontal support bar secured to the forward surface of the back wall of an open type refrigerated food display case. A pair of elongated screws, extending transversely through the depending end portion of the shelf support wall, maintains the plane of the shelf panel horizontal.

The principal object of this invention is to provide a food display shelf which may be removably connected with a display food case support bar in cantilever fashion.

BRIEF DESCRIPTION OF THE DRAWINGS

FIG. 1 is a partially exploded perspective view of the shelf connected with the support bar of a fragmentary portion of a food display case;

FIG. 2 is a vertical cross sectional view, to a different scale, taken substantially along the line 2—2 of FIG. 1; and, FIG. 3 is a fragmentary perspective view of the support wall end portion of the shelf.

DESCRIPTION OF THE PREFERRED EMBODIMENT

Like characters of reference designate like parts in those figures of the drawings in which they occur.

In the drawings:

The reference numeral 10 indicates one end portion of an open top type refrigerated food display case having an upstanding back wall 12 supporting a horizontal support bar 14 in spaced relation forwardly of the case wall forward surface 13 by brackets 16. The support bar 14 is conventional and substantially V-shaped in transverse section defining a rearwardly disposed leg 18 and a forwardly disposed leg 20. The back leg 18 of the V-shape is provided with a plurality of longitudinally spaced apertures 22 and cooperating arcuate recesses 24 formed in the upwardly disposed edge surface of the other leg 20. The purpose of the apertures 22 and recesses 24 is for the reception of pegboard-like rods, not shown, for supporting food items in depending relation therefrom and in overlying relation with respect to the top of the display case 10.

The numeral 30 indicates the shelf, as a whole, preferably formed of transparent plastic material for sanitary reasons, which is rectangular in general configuration comprising a normally horizontal panel 32 having a plurality of vertical openings 34. The panel 32 is provided with upstanding flanged edges 36 along its opposing marginal edges and a forward end flange 38 of equal height with respect to the flanges 36. The other end portion of the panel 32 is provided with an upstanding support or end wall 40 projecting above the horizontal plane of the flanges 36 and 38 a distance at least as great as the transverse width of the end wall.

As shown in FIG. 3, the back side of the end wall 40 is provided with an inverted T-shaped stiffener member 42 of substantially equal thickness and length with respect to the end wall 40 and is secured to the latter, as by bonding (not shown).

The upper end portion of the end wall 40 and stem of the stiffener 42 is centrally apertured, as at 44, for slidably receiving an elongated bolt 46 which projects transversely of the support bar 14 through the recess 24 and aperture 22 and is secured thereto by a washer 48 and nut 50 so that the stem of the stiffener 42 is in contact with a longitudinal portion of the support bar. The depending end portion of the end wall 40 and cross bar of the T-shaped stiffener 42 is provided with preferably two threaded apertures 52 for respectively receiving threaded screws 54 projecting beyond the stiffener 42 and contacting, at their rearwardly disposed ends, the forward surface 13 of the display case back wall 12, thus, positioning the plane of the panel 32 horizontal for receiving and supporting a plurality of prepackaged food articles, not shown.

The purpose of the T-shape for the stiffener 42 is so that one of the shelves 30 may be connected with the support bar 14 adjacent the bracket 16 thus compensating by the thickness of the stiffener, for that portion of the bracket 16 normally projecting forwardly of the forward limit of the upper edge surface of the V-shaped bar leg 20 and thus maintain the longitudinal axis of the shelf panel 32 perpendicular with respect to the longitudinal axis of the support bar 14.

Obviously the invention is susceptible to changes or alterations without defeating its practicability, therefor, I do not wish to be confined to the preferred embodiment shown in the drawings and described herein.

I claim:

1. In combination with an upwardly open refrigerated food display case having a vertical side wall projecting above the case opening and containing an elongated support bar horizontally disposed in parallel spaced relation with said side wall intermediate its height, said support bar having upwardly directed leg portions, one said leg portion having an upwardly open recess therein, another said leg portion, adjacent said side wall, having an aperture cooperatively aligned with the recess;

a shelf panel disposed on that side of said support bar opposite the side wall, said panel having a plurality of openings therethrough and having surrounding upturned flanges, one of said flanges forming an upstanding end wall on said panel projecting above the upper limit of the remaining flanges a distance at least as great as the transverse width of the end wall;

bolt means including an elongated bolt extending through the upper end portion of said upstanding end wall, said support bar leg recess and aperture for connecting said panel to said support bar;

nut and washer means maintaining an end portion of said elongated bolt within the aperture; and, a pair of elongated threaded screws extending through the lower end portion of said upstanding end wall, in transversely spaced relation, and contacting said side wall for supporting said shelf panel horizontally.

* * * * *